US006325596B1

(12) United States Patent
Tomko

(10) Patent No.: US 6,325,596 B1
(45) Date of Patent: Dec. 4, 2001

(54) TURBINE DIAPHRAGM SUPPORT SYSTEM

(75) Inventor: Andrew John Tomko, Glenville, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/621,195

(22) Filed: Jul. 21, 2000

(51) Int. Cl.[7] ..... F04D 29/44
(52) U.S. Cl. ..... 415/209.2
(58) Field of Search ..... 415/209.2, 199.4, 415/199.5, 216, 217, 218, 219 R, 126, 136, 137, 139

(56) References Cited

U.S. PATENT DOCUMENTS 4,190,961 3/1980 James et al. .
4,204,803 5/1980 Leger et al. .
4,616,975 10/1986 Duncan .
6,065,754 * 5/2000 Cromer et al. ..... 277/412

* cited by examiner

*Primary Examiner*—Edward K. Look
*Assistant Examiner*—James M McAleenan
(74) *Attorney, Agent, or Firm*—Nixon & Vanderhye P.C.

(57) ABSTRACT

A diaphragm support bar for a turbine diaphragm comprising a vertical body portion having a support flange extending substantially perpendicularly from an upper end of the vertical body portion and adapted to be supported on a turbine shell component; and a dovetail extending substantially perpendicularly from a lower end of the vertical body portion and adapted to be received within a matching dovetail slot in the diaphragm.

10 Claims, 1 Drawing Sheet

TURBINE DIAPHRAGM SUPPORT SYSTEM

This invention relates to turbomachinery and, specifically, to a system for supporting a split, annular diaphragm in the steam path of a steam turbine.

BACKGROUND OF THE INVENTION

Turbomachines generally comprise stationary and rotating parts defining a flow path for fluid through the turbine. Turbomachines also include an outer fluid tight casing called an outer shell from which a number of stationary parts, including split, annular diaphragms (that mount the fixed nozzles between the stages of the turbine), generally depend radially inwardly. In some prior arrangements, the diaphragms are positioned by radial keys (at the 6 and 12 o'clock positions) and are supported by support bars on opposite sides (in 9 and 3 o'clock positions) of the diaphragms.

The outer shell or casing may also be split along a horizontal joint so that the turbine shell comprises an upper half and a lower half. In building a turbomachine, certain stationary parts are mounted in the lower half shell whereas other stationary parts are mounted in the upper half shell while the two mating components are apart. The two halves are then assembled along a horizontal joint after the rotor has been mounted in the lower half.

As already noted, the diaphragms may likewise be split along a horizontal joint and comprise upper and lower diaphragm halves. The lower diaphragm halves are each mounted in the lower shell, and after rotor installation, the upper diaphragm halves are bolted to the lower diaphragm halves. It is necessary, however, to align the diaphragms with the rotor to insure a uniform and desired radial gap between them.

Traditionally, large diaphragms have been supported radially by pads bolted to the sides of the lower half diaphragm, and supported by the lower turbine shell. The current design uses a rectangular slot and bolts to fasten the diaphragm support or pad to the diaphragm. With higher turbine power density designs in fixed outer shells, however, the available space for current supporting systems has become problematic. Supporting blocks or pads, hold down bolts, sealing keys and lifting holes, etc. all vie for the limited space.

In addition, with current designs, alignment of the diaphragms can only be achieved by removing the rotor from the shell. There is thus a need for simplified diaphragm construction that conserves space, reduces alignment time and errors, and also minimizes crane usage for rotor removal.

BRIEF SUMMARY OF THE INVENTION

This invention provides a new system for supporting steam turbine diaphragms radially within the steam path. It also provides diaphragm alignment capability without removing the rotor from the casing. The new support system for turbine diaphragms includes a support bar that incorporates a dovetail for mating engagement with a dovetail slot in the outer ring of the lower diaphragm half that carries the load and maintains radial position. This arrangement is provided on both sides of the diaphragm.

Specifically, each support bar in accordance with the exemplary embodiment of the invention includes a vertical body portion with an outwardly directed support flange at an upper end thereof, and an inwardly directed dovetail adjacent a lower end thereof. The supporting flange is adapted to engage a shoulder of the lower casing half via a plurality of adjustment shims, a shim pack clamping block, and a shim pack clamping bolt. The shims are employed to align the diaphragm as necessary, relative to the rotor. The dovetail is engaged with, or seated within, a mating dovetail slot formed in the diaphragm lower half, adjacent the split line (i.e., the interface between the upper and lower diaphragm halves).

It will be appreciated that because the upper diaphragm halves are bolted to the lower diaphragm halves (after rotor installation), the support bars carry the full weight of the diaphragms.

A set screw approximately mid-way along the support bar is used to stabilize and align the lower diaphragm half, while an additional set screw extends through the dovetail itself, bearing on the base of the dovetail slot, thus enabling the dovetail joint to be securely locked.

The above described dovetail design eliminates the bolts and drilled holes in the outer ring of the diaphragm, and provides additional advantages with respect to design simplicity, flexibility, quicker and more accurate alignment, and decreased maintenance. Moreover, the design permits direct alignment of turbine rotors with the stationary components (diaphragms) in the turbine shell, thus avoiding alignment errors caused by translating data from other alignment techniques.

In its broader aspects, therefore, the present invention relates to a diaphragm support bar for a turbine diaphragm comprising a vertical body portion having a support flange extending substantially perpendicularly from an upper end of the vertical body portion; and a dovetail extending substantially perpendicularly from a lower end of the vertical body portion.

BRIEF DESCRIPTION OF THE DRAWINGS

The FIGURE is as partial cross-section illustrating a support system for a steam turbine diaphragm in accordance with the invention.

DETAILED DESCRIPTION OF THE INVENTION

Figure 1:
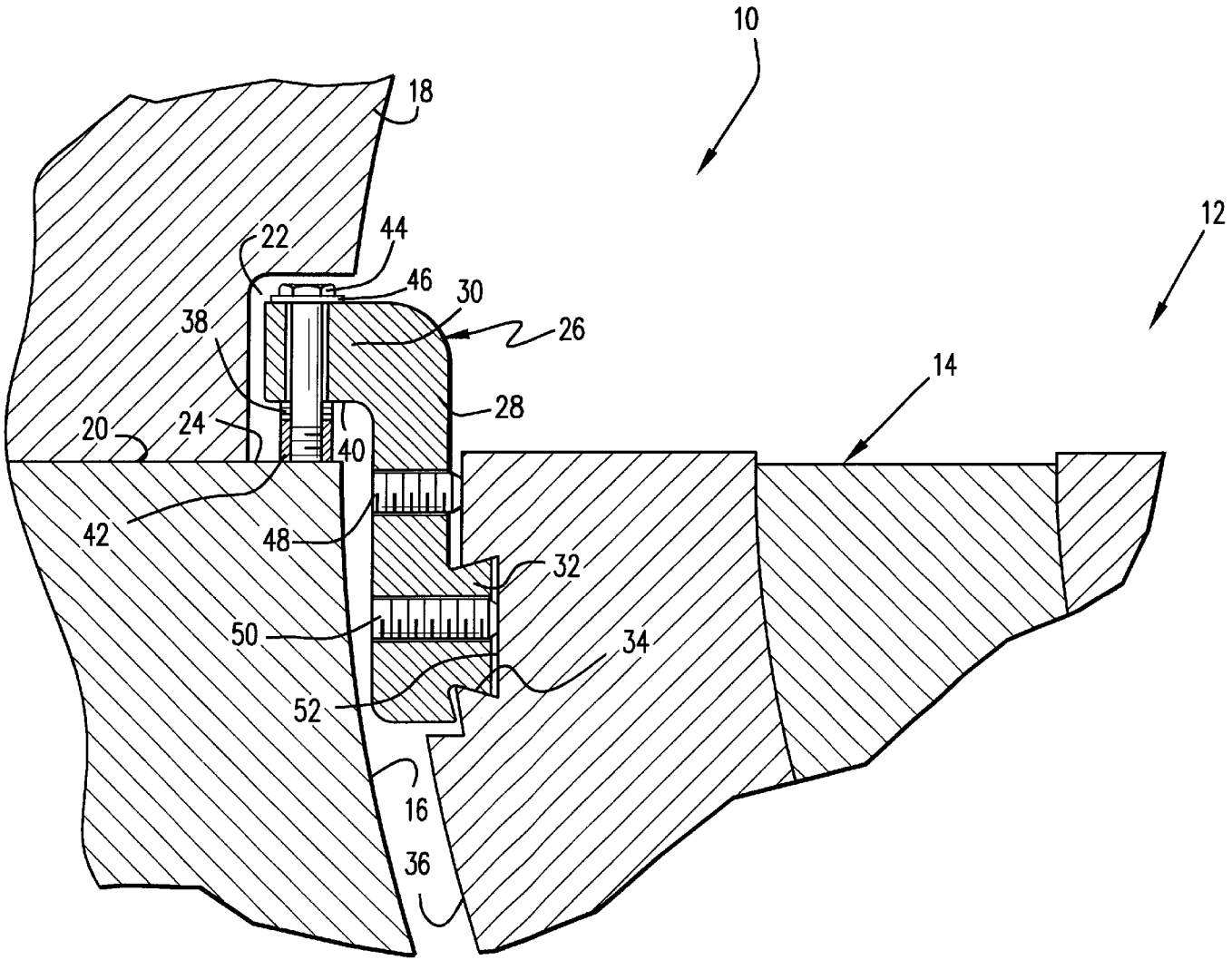

The FIGURE illustrates a support system 10 for a steam turbine diaphragm 12, and specifically the lower half 14 of a split diaphragm (the upper diaphragm half is not shown). The lower diaphragm half 14 is positioned within a lower shell 16, partly shown. An upper shell 18 is also partly shown, with a split line 20 at the juncture of the upper and lower shells. The upper shell includes a recess or pocket 22 that facilitates the use of a horizontal edge portion 24 of the lower shell 16 along the split line 20 for supporting the diaphragm. In this regard, it will be appreciated that the upper diaphragm half is supported on, and bolted to the lower diaphragm half in conventional fashion, after the lower diaphragm half and rotor have been installed in the lower shell 16.

A diaphragm support bar 26 in accordance with an exemplary embodiment of this invention includes a vertical body portion 28 having a 90°, outwardly directed support flange 30 at its upper end, and a 90°, inwardly projecting dovetail 32 adjacent its lower end. The dovetail 32 is adapted for mating engagement within a dovetail slot 34 formed in the outer surface 36 of the lower diaphragm half 14. The upper support flange 30 projects into the pocket 22, enabling the lower diaphragm half 14 to be supported on the edge portion 24 of the lower shell 16. In addition, one or more shims 38 (also referred to as a "shim pack") are sandwiched between a lower surface 40 of the flange 30 and a shim pack clamping block 42 supported directly on the horizontal edge portion 24 of the lower shell 16. A shim pack clamping bolt 44 (with one or more washer shims 46 to adjust hold down clearance) extends through the flange 30 and into a threaded bore in the clamping block 42. With the lower diaphragm half 14 thus supported in the lower shell, the rotor (not shown) may be installed. Subsequently, the upper diaphragm half is located on the lower diaphragm half and bolted thereto by screws, now shown. Thus, both the upper and lower diaphragm halves are supported by the support bars 26.

It will be appreciated that shims 38 can be added or removed to align the diaphragm relative to the rotor. Vertical adjustment can be accomplished by adding or removing a like number of shims 38 from both sides of the diaphragm, whereas side-to-side "rocking" alignment (about a radial pin, not shown, at the 6 o'clock position) of the lower diaphragm half by differential addition or subtraction of shims 38 from the support bar on the opposite side of the diaphragm.

A first set screw 48 extends through the support bar 28 above the dovetail 32 so as to engage the outer surface 36 of the lower diaphragm half 14 and thus set the support bar relative to the lower diaphragm half.

A second set screw 50 extends horizontally through the bar 28 and the dovetail 32 so as to engage the base 52 of the dovetail slot 34. This enables the dovetail joint to be locked securely in the desired position.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A diaphragm support bar for a turbine diaphragm comprising:

a vertical body portion having a support flange extending substantially perpendicularly from an upper end of the vertical body portion; and a dovetail extending substantially perpendicularly from a lower end of the vertical body portion for attachment to the turbine diaphragm.

2. The support bar of claim 1 wherein said support flange and said dovetail extend in opposite directions from said vertical body portion.

3. The support bar of claim 1 including a clamping bolt that extends through a bore in said support flange and threadably engages a shim clamping block below said support flange, with one or more shims between said support flange and said clamping block.

4. The support bar of claim 1 including first set screw extending horizontally through said vertical body portion and through said dovetail.

5. The support bar of claim 1 including a second set screw extending horizontally through said vertical body portion, axially between said support flange and said dovetail for stabilizing the support bar relative to the turbine diaphragm.

6. A turbine diaphragm assembly comprising a diaphragm adapted to surround a rotor, said diaphragm including a lower diaphragm half having an axially extending dovetail slot on each of opposite sides of said lower half diaphragm; and a diaphragm support bar adapted for mounting in each of said dovetail slots, each said support bar comprising a vertical body portion having a support flange extending substantially perpendicularly from an upper end of the vertical body portion and adapted to be supported on an edge portion of a lower turbine shell; and a dovetail extending substantially perpendicularly from a lower end of the vertical body portion engaged in said dovetail slot.

7. The support bar of claim 6 wherein said support flange and said dovetail extend in opposite directions from said vertical bar portion.

8. The support bar of claim 6 wherein said support flange is provided with a clamping bolt that threadably engages a shim clamping block below said support flange, with one or more shims between said support flange and said clamping block, said clamping block supported on said edge of said lower turbine shell.

9. The support bar of claim 6 including a first set screw extending horizontally through said vertical body portion and through said dovetail to engage a base of said dovetail slot.

10. The support bar of claim 6 including a second set screw extending horizontally through said vertical bar portion, axially between said support flange and said dovetail and engaging said lower diaphragm half to thereby stabilize the support bar relative to the diaphragm.

* * * * *

UNITED STATES PATENT AND TRADEMARK OFFICE

CERTIFICATE OF CORRECTION

PATENT NO. : 6,325,596 B1
DATED : December 4, 2001
INVENTOR(S) : Tomko

It is certified that error appears in the above-identified patent and that said Letters Patent is hereby corrected as shown below:

Column 3,
Line 11, delete "now" and insert -- not --.

Column 4,
Lines 28, 31, 37 and 41, delete "support bar" and insert -- turbine diaphragm assembly --.

Signed and Sealed this

Second Day of July, 2002

*Attest:*

*Attesting Officer*

JAMES E. ROGAN
*Director of the United States Patent and Trademark Office*